United States Patent [19]

Fogel

[11] 4,160,296

[45] Jul. 10, 1979

[54] WATERBED HEADBOARD BRACKET

[75] Inventor: Isaac Fogel, Silver Spring, Md.

[73] Assignee: Classic Products Corporation, Beltsville, Md.

[21] Appl. No.: 880,472

[22] Filed: Feb. 23, 1978

[51] Int. Cl.[2] ..... A47G 9/00

[52] U.S. Cl. ..... 5/285; 5/400

[58] Field of Search ..... 5/53 R, 92, 176 R, 279 R, 5/280, 308, 317, 370, 371, 289, 286; 248/287, 300

[56] References Cited

U.S. PATENT DOCUMENTS

| | | | |
|---|---|---|---|
| 1,556,431 | 10/1925 | Eberman | 248/300 |
| 2,799,868 | 7/1957 | Sands | 5/53 R |
| 3,173,178 | 3/1965 | Kumburis | 248/300 |
| 3,249,953 | 5/1966 | Liskin et al. | 5/285 |
| 3,730,469 | 5/1973 | Shields | 248/287 |
| 3,996,633 | 12/1976 | Burke | 5/370 C |
| 4,073,019 | 2/1978 | Fraser | 5/365 |

*Primary Examiner*—Casmir A. Nunberg
*Attorney, Agent, or Firm*—Anne M. Kornbau

[57] ABSTRACT

A waterbed headboard bracket is disclosed for attaching a headboard to a waterbed frame. The waterbed headboard bracket comprises a Z-shaped elongated element including a pair of leg sections joined by an integral middle section. Each of the leg sections has a pair of slots for attaching to the waterbed frame and to the headboard. One pair of slots extend in the elongated direction of the elongated element. The other pair of slots extend transverse to the elongated direction of the elongated element. With the bracket mounted on the waterbed frame and the headboard, the headboard can be adjusted in the vertical and horizontal direction in relation to the waterbed frame.

5 Claims, 3 Drawing Figures

WATERBED HEADBOARD BRACKET

BACKGROUND OF THE INVENTION

The present invention relates to a waterbed headboard bracket, and in particular, to a waterbed headboard bracket which allows vertical and horizontal adjustment of the headboard.

It is a common practice in assembling a bed to include a headboard as a supporting part of the frame. The frame generally consists of a pair of side rails, a footboard and a headboard. The footboard and headboard rest on the floor providing support for the entire frame.

An arrangement for connecting a headboard to a bed frame is shown in Hoit, U.S. Pat. No. 1,270,414, where the bed frame is supported by legs at each corner and the headboard is bolted flush to the frame. The headboard does not provide support for the frame and, in fact, the headboard is supported by the frame.

Most modern bed headboards are located a short distance from the edge of the mattress to provide room to tuck the bed sheets in under the mattress and to keep a sleeper's head away from the hard surface of a headboard.

A bed frame which supports a box spring and mattress where the headboard is supported by the frame has come to be known as a Hollywood bed. The frame for this type of bed has been constructed of steel angles or tubing joined to form a mattress support. The frame is supported on legs and has brackets to support a headboard. The brackets are welded to the frame along the end identified as the headboard end. There is little or no adjustment of the headboard in either the vertical or horizontal direction, since the bracket is fixed and provides no adjustment for a headboard. U.S. Pat. No. 3,249,953, issued to Liskin discloses a bed frame showing a headboard bracket mounted on the frame to support a headboard above the floor. The headboard bracket is in the form of an angle welded to one leg of the frame. The bracket has slots to receive bolts from a headboard. The slots provide horizontal adjustment of the headboard in relation to the bed frame.

With the advent of waterbeds, a new type of frame structure was developed to support a water-filled mattress. Generally, the most commonly used structure includes a platform or pedestal which raises the height of the mattress to the level of a conventional bed. The pedestal may be of any structural design, usually commercial pedestals are somewhat less in dimension than the mattress and the supporting frame. The waterbed frame, therefore, may extend beyond the pedestal as much as a foot on all four sides. The waterbed frame includes a decking board, which rests on the pedestal, and an upstanding frame structure that includes rails. A waterbed mattress is supported on the decking board within the frame. The pedestal and frame combination provides a basic unit which can be used for comtemporary or traditional decor. With the pedestal being smaller dimension than the frame, a headboard and footboard of any decor can be used, since the pedestal can be hidden by bed covers in the case of a traditional decor or used as a part of the decor in a contemporary decor.

While the basic unit of a pedestal and waterbed frame is versatile in that it can be used with several decors, there is a problem in mounting a headboard on the frame where the headboard does not rest on the floor. Also there is another problem of aligning the headboard in relation to the frame, whether or not it rests on the floor or is supported by the frame. In addition, it has been learned through experience that the headboard should have an adequate clearance from the frame in order to work with a water-filled mattress, either to make the bed or to install the mattress on the frame.

The alignment of a headboard in relation to the frame sometimes requires a trail and error process to compensate for misalignment. This can be minimized if the bracket is constucted to provide both horizontal and vertical adjustment simultaneously. Not only should the headboard move in a horizontal and vertical direction, it should move in on the diagonal which would eliminate moving first in the horizontal or vertical direction and then the other. The bracket of the present invention provides horizontal, vertical or diagonal movement, either separately or simultaneously.

The prior headboard brackets do not allow for easy installation of the headboard on the frame. Therefore, installation requires either special tools or several time consuming steps. The bracket of this invention makes it easy for a person to install a headboard without the use of special tools, or a number of steps. This is because the bracket spaces the headboard an adequate distance from the frame which allows easy installation of fasteners and access for tightening tools. With the headboard spaced from the frame, there is no problem in working with the waterbed mattress as in prior bed frame constructions.

The present invention is constructed to support a headboard and allow simple adjustment both vertically and horizontally.

SUMMARY OF THE INVENTION

It is an object of this invention to provide a waterbed headboard bracket for supporting a headboard away from the waterbed frame, while being capable of vertical and horizontal adjustment.

It is another object of this invention to provide a waterbed headboard bracket of a unitary construction which is inexpensive to manufacture.

It is a further object of this invention to provide a waterbed headboard bracket with vertical slots and horizontal slots for easy adjustment.

Still another object of this invention is to provide a waterbed headboard bracket which is simple to install and to adjust.

The waterbed headboard bracket of this invention includes a Z-shaped elongated bracket structure having a pair of leg sections separated by a middle section which is at a right angle to each of the leg sections. There is a pair of adjustment slots in each of the leg sections where one pair of adjustment slots extends in the elongated direction of the Z-shaped elongated bracket and the other pair of adjustment slots extends in a transverse direction to the elongated direction of the Z-shaped elongated bracket. With the adjustment slots at right angles to one another both vertical and horizontal adjustment of the headboard can be made without too much trouble.

DESCRIPTION OF THE PREFERRED EMBODIMENT

Figure 1:
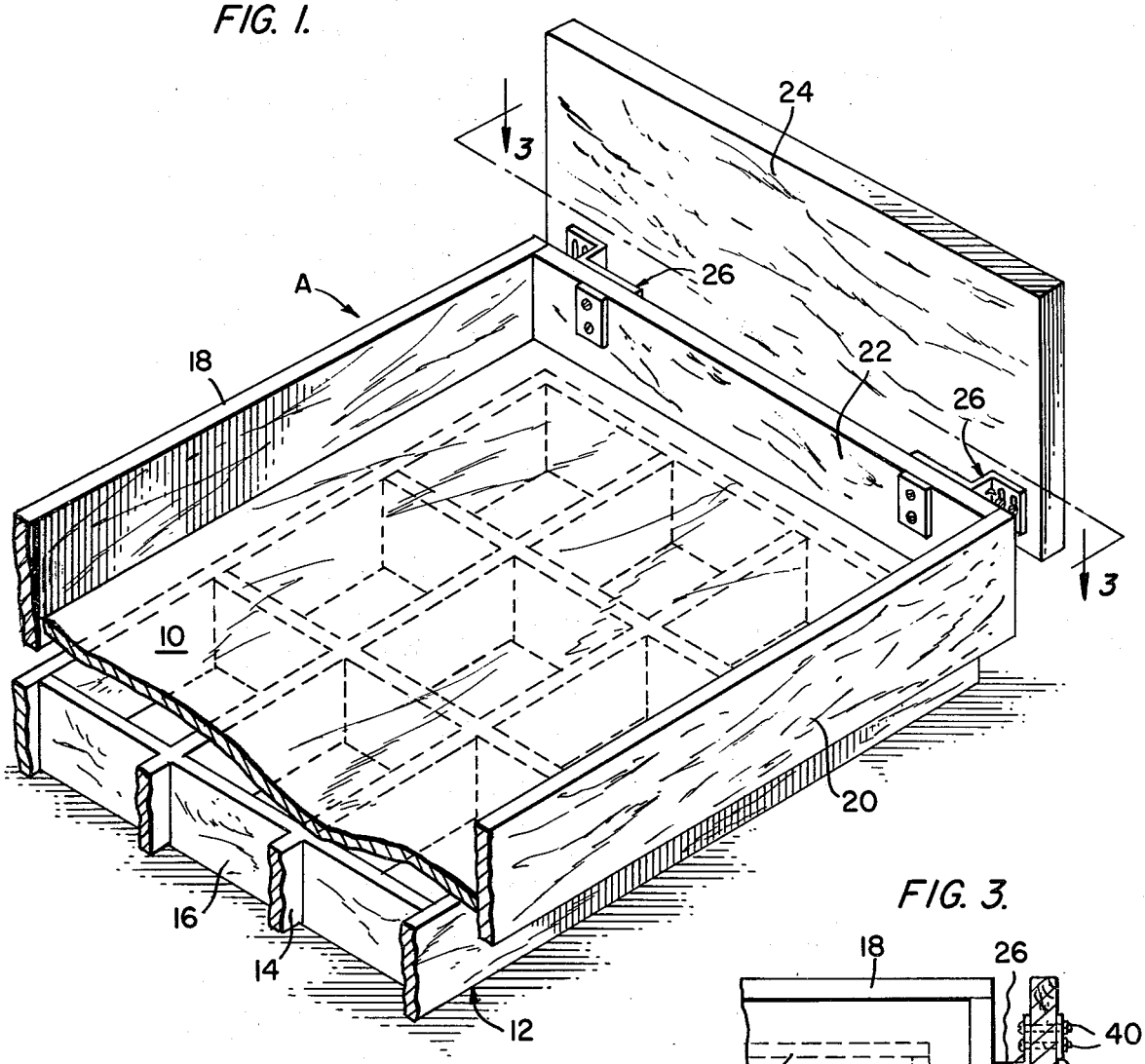
FIG. 1 is a perspective view of a waterbed frame showing the brackets of this invention.
Figure 3:
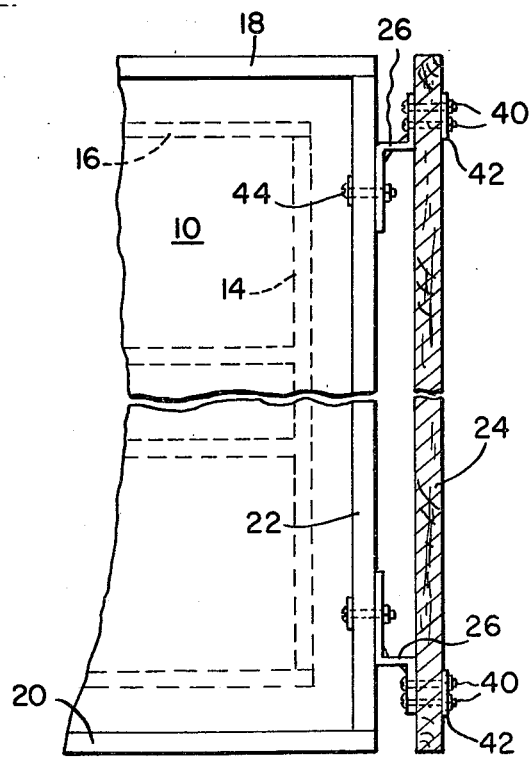
FIG. 3 is a top plane view of the waterbed headboard bracket of this invention looking in the direction of the line 3—3 of FIG. 1.

Referring to FIG. 1 of the drawings, there is shown a waterbed frame A. The frame includes a pedestal 12 formed of cross members 14 and 16. The cross members may be formed of an egg crate-like arrangement where each of the members is notched to fit together as shown in FIG. 1. Resting on the pedestal 12 is a decking board 10 of a plywood, composition board or heavy duty corrugated paper. Upstanding rails 18, 20, and 22 form the rest of the frame, with the footboard not shown. The rails are permanently attached to the decking board and to each other to form a rigid structure. Headboard 24 is attached to the railboard 22 by a bracket 26 of this invention. The headboard 24 shown is supported above the floor by the brackets 26. It is realized that other types of headboards will work equally well.

Figure 2:
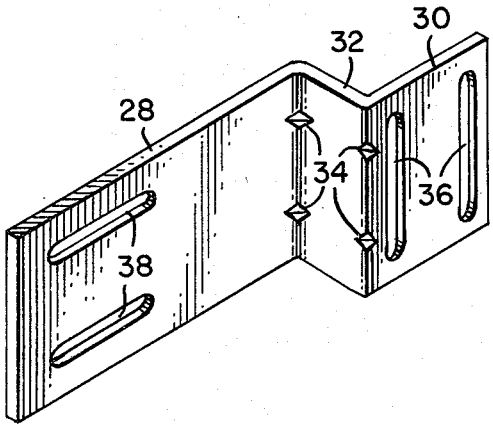
FIG. 2 is a perspective view of the waterbed headboard bracket of this invention.

FIG. 2 illustrates a bracket 26 of this invention fastened to a waterbed frame A and to a headboard 24. The bracket 26 consists of a sheet metal blank formed to provide a pair of leg sections 28 and 30 joined by right angle bends forming a middle section 32. The bracket is rectangular in shape and is designed to be mounted to the railboard 22 of the waterbed frame A in the elongated direction shown in FIG. 1. When formed the bracket 26 resembles a Z-shape with leg section 28 being longer in length than leg section 30. Leg section 28 is made longer to provide the length necessary to include a pair of slots 38, which will be discussed later. The added length of leg section 20 is needed to mount the bracket closer to the middle of the rail 22 which is aesthetically desirable and to distribute the weight of the headboard along the length of the rail.

Leg section 30 is somewhat shorter than leg section 28 since it is the section which attaches directly to the headboard 24 and provides for vertical adjustment of the headboard. Leg section 30 has slots 36 for vertical adjustment, these slots will also be discussed later.

As shown leg section 28 is off-set from leg section 30 by the width of middle section 32 which preferably may be between 2 to 3 inches. Looking at the bracket 26 in FIG. 2, the off-set of leg section 28 in relation to leg section 30 forms the above described Z-shaped structure. Since the bracket 26 will support headboards of considerable weight the right angle bends between leg sections 28 and 30 and middle section 32 are reinforced by indents 34; four such indents are shown.

There is a pair of parallel slots 36 in leg section 30 which are transverse to the elongated direction of the bracket 26. These slots 36 are used to adjust the headboard 24 vertically. A second pair of parallel slots 38 in leg section 28 extends longitudinally in the bracket for horizontal adjustment of the headboard 24. Slots 36 and 38 preferably may be about 2 inches in length and about ⅜ of an inch wide. The pairs of slots are parallel and generally are separated from each other about 2 inches.

The brackets 26 are attached to the railboard 22 by fasteners, such as bolts and nuts 44 which protrude through holes bored in railboard 22. The bolts 44 should be backed by washers or reinforcing plates to distribute the weight of the headboard 24. The bolts preferably are not tightened at this time. The headboard 24 is attached to the brackets 26 by bolts and nuts 44 which should be backed with a reinforcing plate 42 to prevent the bolts 44 from pulling through the headboard. Again the bolts and nuts 44 are not tightened.

The headboard is adjusted to align in relation to the waterbed frame by moving the brackets horizontally to align with side railboards 18 and 20, and vertically to raise the height of the headboard. Once in position the bolts and nuts are tightened. Of course, both horizontal and vertical adjustment can be made by moving the headboard on the diagonal and tightening the bolts and nuts at the point the headboard is aligned.

Although only one embodiment of the waterbed headboard bracket has been described and illustrated in the drawings, it will be understood that various modifications and changes may be made by those skilled in the art without departing from the inventive concept. Reference should therefore be made to the appended claims for a definition of the scope of the invention.

What is claimed is:

1. A waterbed headboard bracket for supporting a headboard comprising:
   - an elongated member having a first right angle bend and a second right angle bend forming a first leg and a second leg integrally joined by a transverse element;
   - a first pair of elongated slots in said first leg;
   - a second pair of elongated slots in said second leg; and
   - reinforcement means on the inside of said first right angle bend and said second right angle bend.

2. A waterbed headboard bracket as claimed in claim 1 wherein said first leg and said second leg are in the same plane, and said transverse element is in a plane transverse to said first and second legs.

3. A waterbed headboard bracket as claimed in claim 2 wherein the first pair of elongated slots extend in the elongated direction of said elongated member and said second pair of elongated slots extend in a direction transverse to the elongated direction of said elongated member.

4. A waterbed headboard bracket as claimed in claim 3 wherein said elongated member is bent to form a Z-shape.

5. A waterbed headboard bracket as claimed in claim 4 wherein said second pair of slots is at a ninety degree angle to said first pair of slots.

* * * * *